US008434956B2

(12) United States Patent
Cabatan

(10) Patent No.: US 8,434,956 B2
(45) Date of Patent: May 7, 2013

(54) ADAPTER FOR WRITING INSTRUMENTS

(76) Inventor: Chana Cabatan, Carson, CA (US)

( * ) Notice: Subject to any disclaimer, the term of this patent is extended or adjusted under 35 U.S.C. 154(b) by 1023 days.

(21) Appl. No.: 12/344,432

(22) Filed: Dec. 26, 2008

(65) Prior Publication Data

US 2009/0169285 A1 Jul. 2, 2009

Related U.S. Application Data

(60) Provisional application No. 61/016,671, filed on Dec. 26, 2007, provisional application No. 61/100,611, filed on Sep. 26, 2008.

(51) Int. Cl.
*B43K 7/12* (2006.01)

(52) U.S. Cl.
USPC ..... 401/112

(58) Field of Classification Search ..... 401/109–114, 401/99, 117
See application file for complete search history.

(56) References Cited

U.S. PATENT DOCUMENTS

| | | | | |
|---|---|---|---|---|
| 2,500,979 | A | 3/1950 | Coler-Dark | |
| 3,137,276 | A | 6/1964 | Weisser | |
| 3,272,184 | A | 9/1966 | Crowley | |
| 3,288,115 | A | 11/1966 | Hechtle | |
| 4,167,350 | A | 9/1979 | Harris | |
| 4,459,059 | A | 7/1984 | Greenspan | |
| 4,522,522 | A | 6/1985 | Zeitelhack | |
| D303,992 | S | 10/1989 | Grotsch | |
| 4,991,988 | A * | 2/1991 | Snell et al. | 401/111 |
| 5,048,989 | A | 9/1991 | Stageman | |
| 5,048,991 | A | 9/1991 | Guo | |
| D386,526 | S | 11/1997 | Ito | |
| 6,276,854 | B1 | 8/2001 | Mullins | |
| 6,280,110 | B2 | 8/2001 | Lin | |
| 6,379,068 | B1 | 4/2002 | Yu | |
| 6,773,185 | B1 | 8/2004 | Hsieh | |
| 6,793,429 | B2 | 9/2004 | Arrison | |
| 6,854,158 | B2 | 2/2005 | Fu | |
| 2002/0032069 | A1 | 3/2002 | Arrison | |

FOREIGN PATENT DOCUMENTS

| | | |
|---|---|---|
| GB | 755879 | 8/1956 |
| JP | 2002019379 A | 1/2002 |
| JP | 2006159433 A | 6/2006 |

OTHER PUBLICATIONS

Office Action dated Nov. 14, 2011 from Canadian counterpart application 2,710,314.
English translation of abstract: JP2002019379A.
English translation of abstract: JP2006159433A.
Corresponding International Search Report and Opinion for PCT/US2008/088380.

* cited by examiner

*Primary Examiner* — Huyen Le
(74) *Attorney, Agent, or Firm* — WPAT, P.C.; Anthony King

(57) ABSTRACT

An adapter for pen, pencil, or any other types of writing instruments where the adaptor is sized and dimensioned to receive a regular sized writing instrument, and the adapter is designed for safety to use such writing instrument as a refill. The design has an inner holder designed to securely hold the writing instrument. In one embodiment, the adapter is short enough to expose a proximal end of the writing instrument, so that the exposed part of the writing instrument becomes a push button. In another embodiment, the adapter has a push button, and the regular sized writing instrument is entirely contained with the adapter. Other embodiments use different retracting mechanism such as twist-and-retract mechanism, and slider mechanism.

13 Claims, 10 Drawing Sheets

ADAPTER FOR WRITING INSTRUMENTS

CROSS-REFERENCE TO RELATED APPLICATIONS

This application claims priority to U.S. Provisional Patent Application Nos. 61/016,671, filed on Dec. 26, 2007, and 61/100,611, filed on Sep. 26, 2008, both of which are hereby incorporated by reference in their entireties.

Although incorporated by reference in their entireties, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of the entire prior art of record and any search that the Office deems appropriate.

BACKGROUND OF THE INVENTION (1) Field of the Invention

The field of the invention is a writing instrument, more specifically, an adapter to hold a writing instrument so that the writing instrument is retractably retained either partially or entirely within the adapter.

(2) Description of Related Art Including Information Disclosed Under 37 CFR 1.97 and 1.98

Typical pens are sold with caps so that the writing tip may be protected when the pen is not in use for writing. Despite the relative effectiveness in protecting a writing tip, the typical pens with cap have several disadvantages. First, when a user loses the cap of the pen, it becomes difficult for the user to carry the pen in his/her pocket without staining his/her garment. Second, capping and uncapping a typical pen requires a user to use both hands. This is particularly difficult if the user needs to use one hand to hold another object, such as, a clip board. Third, when a cap is lost a user may injure oneself and/or another due to the tip being exposed.

Generally known methods of protecting the writing tip of a pen without using a cap includes using a tractable mechanism so that the ballpoint and the ink filling can be retracted into the body of the pen. For example, clicker pens are commonly used when a push of a button retracts the writing tip. Also, twist-and-retract type of mechanism is also known to move the ink filling and the ballpoint in a longitudinal direction within the outer body of the pen. These types of pens allow a user to retract/extend the ballpoint of the pen using only one hand, while freeing the other hand to perform other tasks. Despite numerous desirable properties, however, retractable pens of these types are typically more expensive than regular pens with caps. Therefore, when businesses make purchasing decisions regarding office supplies, they are likely to purchase regular pens with caps, instead of clicker pens.

There is a continuing need for new ways to protect writing tips of writing instruments in a cost-effective way, to help employees prevent staining of their garment when using regular pens, and more importantly to serve as a safety mechanism from injury.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

Improved embodiments of an adapter for a writing instrument are hereby disclosed. The general concept is to provide an adapter that is sized and dimensioned so that the adapter can enclose a regular pen or pencil and turn the regular pen or pencil into a clicker pen/pencil, or a twist-and-retract type of pen/pencil. The adapter is also suitable for other types of writing instruments. Such adapter is particularly useful at places of employment where, for economic and safety reasons, business owners prefer to purchase only regular pens and pencils for its employees, yet the employees would rather prefer using pens and pencils that can be easily retracted using only one hand. Using the hereby disclosed inventive subject matter, employees of such businesses can simply throw away the cap on the regular ball-point pen, and then insert the regular pen into the adapter for use. Once properly install into the adapter, the adapter having a regular pen enclosed basically turns into a clicker or twist-to-retract pen. This adapter may be reused over and over again. A user can now easily retract and extend the writing tip of the regular pen or pencil using only one hand.

In some embodiments, the adapter is short enough that the writing instrument is partially exposed outside of the adapter. When the end of the pen opposite of the writing tip is exposed, a user may retain the cap and place the cap over such end so they may continue to use the cap as a clip for his front shirt pocket.

Other embodiments of the adapter are available to hold different pens having different diameters. In another contemplated embodiment, the adapter has a universal design such that it can hold at least two different brands/diameters of ball-point pens.

While the adapter can use a clicker pen type of mechanism to retract/extend the writing instrument, other types of mechanism is also contemplated. For example, the adapter can use a twister pen type of mechanism (or sometimes called rotator type). Known twister pens are pens where a user twists a portion of the pen body to retract/extend the tip of the ball-point refill.

One of ordinary skilled in the art will immediately see that many other known mechanisms for retracting/extending ball-point tip can be used here for the purpose of holding, and retracting/extending the writing tip from the adapter.

DETAILED DESCRIPTION OF THE INVENTION

Figure 1:
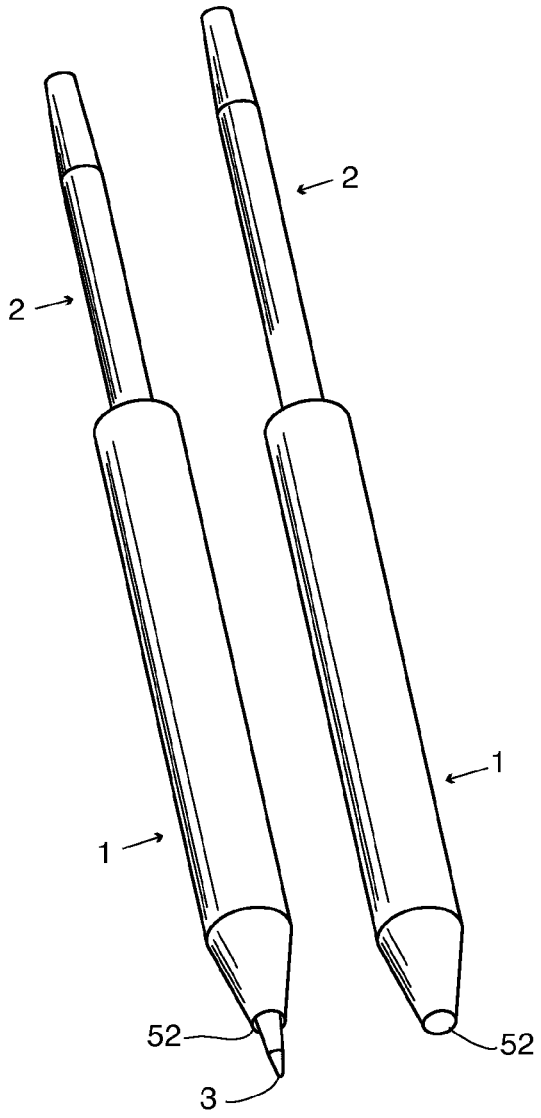
FIG. 1 is a perspective view of a first embodiment of the adapter, one with the writing tip extended and one with the writing tip retracted.

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below. It should also be noted that the drawings are in simplified form and are not to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. In the absence of specific definition, such directional terms should not be construed to limit the scope of the invention in any manner.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub combination or variation of a sub combination.

Figure 3:
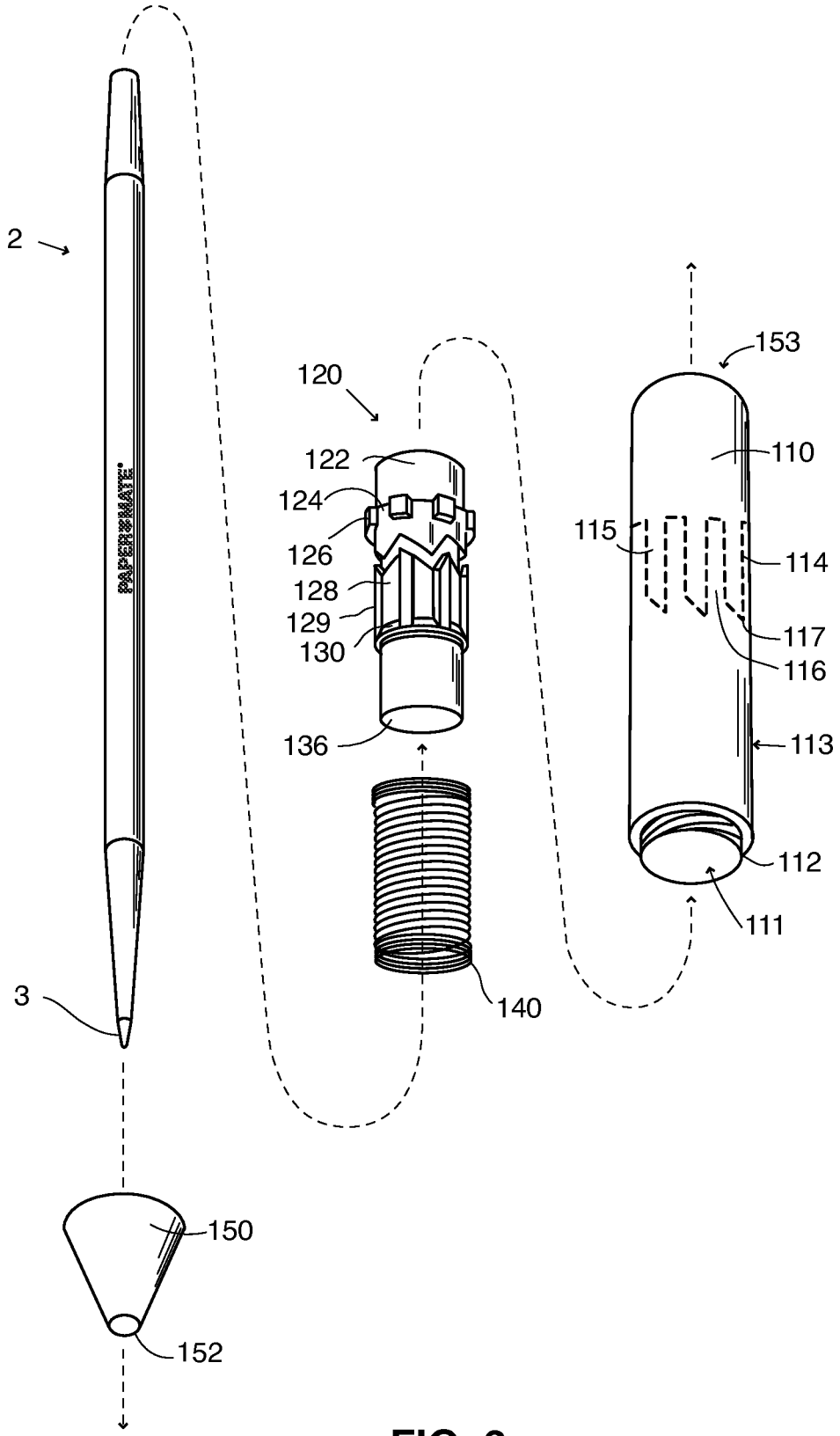
FIG. 3 is an exploded view of a first embodiment of the adapter with a pen.

As used herein, the term "filler" in conjunction with a regular pen refers to a typical tubular reservoir that holds ink. The filler is typically coupled to a writing tip, such as a ballpoint. Other terms that may be used in this application to describe "filler" are "refill," "re-fill," and "cartridge." The filler is typically enclosed within a plastic outer tube. For example, FIG. 3 shows a Paper Mate® pen 2 commonly available in retail stores within the United States. What is shown in FIG. 3 is just the plastic outer tube. What is not shown is the transparent filler that is enclosed within the plastic outer tube.

As used herein, the term "off-the-shelf writing instrument" refers to a writing instrument that is commonly commercialized and sold in retail stores. Such writing instruments are ready for use by the consumer upon purchase, without further installation or assembly. Therefore, an "off-the-shelf writing instrument" does not refer to a pen re-fill, or a pen filler. For example, an "off-the-shelf writing instrument" includes a Paper Mate® pen 2 as shown in FIG. 3, and a BIC® pen, and a wooden pencil with lead.

FIG. 1 generally depicts a preferred embodiment of the adapter 1. In FIG. 1, the adapter 1 is shown with a regular Paper Mate® pen 2 inserted in a lumen of the adapter. The left adapter 1 has a writing tip 3 of a pen 2 extended through a distal opening 52. The right adapter 1 has the same pen 2 assembled within the lumen of adapter 1, and the writing tip 3 of the pen 2 is retracted in the adapter 1.

Figure 2:
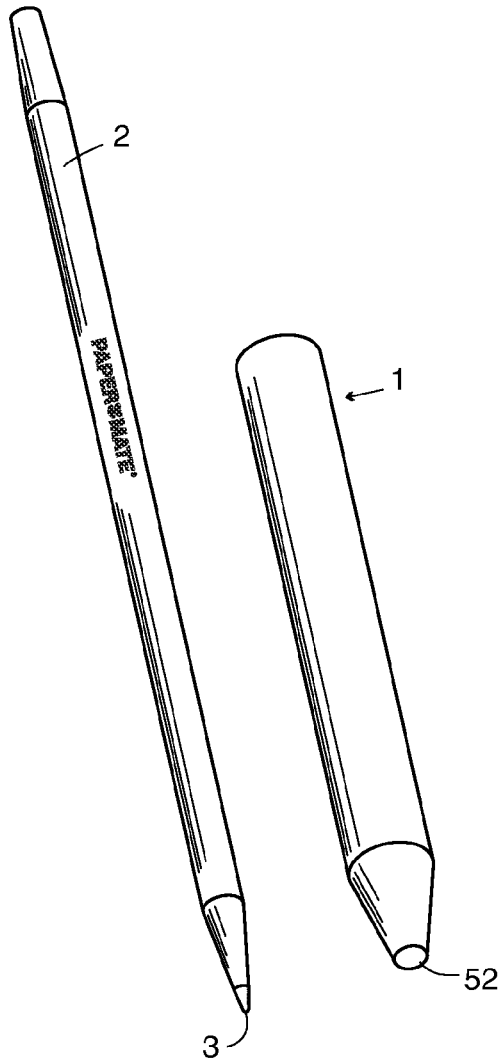
FIG. 2 is a perspective view of a first embodiment of the adapter, with the writing instrument removed from the adapter.

FIG. 2 shows a regular pen 2 along side the adapter 1. The preferred embodiment of adapter 1 can accommodate different types of pen. For example, the same adapter 1 in FIG. 2 can accommodate a Paper Mate® pen, and the Paper Mate® pen 2 may be replaced with a BIC® pen, or a wooden pencil.

FIG. 3 illustrates the assembly of adapter 1 and pen 2. Here, a shorter embodiment of the invention is shown. This shorter embodiment of a retractable adaptor 1 is for holding an off-the-shelf writing instrument 2 having a writing tip 3. The adapter 1 has an adapter body 110 with a distal end, a proximal end, and a lumen 111 within the adapter body 110 to partially enclose the writing instrument 2.

There is an opening 152 at the distal end of the adapter body 110 allowing a writing tip of the writing instrument to pass through. There is also an opening 153 at the proximal end of the adapter body 110 allowing a proximal end of the writing instrument to pass through. Preferably, the distal region of the adapter body 110 having opening 152 can be detached. In FIG. 3, this distal region is a detachable cone tip 150. The cone tip 150 can be reattached to the main body 113 of the adapter body 110 via screw blades 112 disposed on the distal end of the main body 113. Detaching the cone tip 150 from the main body 113 requires a simple twist of the cone tip 150.

Once assembled, the inside of the cone tip 150 makes abutting contact with a compression coil spring 140.

The lumen 111 of the adapter body 110 contains a holder 120. The purpose of a holder 120 is to make secure contact with the writing instrument 2. Holder 120 can securely grip the writing instrument 2 so that longitudinal movement of the holder 120 causes the writing tip 3 to extend or retract from the distal opening 152 of the adapter body 110.

To effectively make engaging contact with the writing instrument 2, the inner side 136 of the holder 120 needs necessary structure, texture, and/or material to facilitate a secure contact. Preferably, the secure contact is not permanent, and the writing instrument 2 may be readily removed from holder 120 when the user wishes to replace the writing instrument 2 with a new writing instrument 2. In the most preferred embodiment, the diameter of the inner side 136 of holder 120 narrows towards one end. Even more preferably, the diameter narrows towards the proximal end to help securely couple to the writing instrument 2.

Contemplated adapter 1 preferably has a holder 120 to securely hold writing instruments having an outer tubular body of an outer diameter of at least 6 mm; or more preferably, 7 mm or greater. There are various retractable pens in the prior art, and they are designed to retract a pen filler. Furthermore, pen fillers are known to have rather small diameters. Typical pen fillers have an outer diameter of about 3.5 mm. It is of common knowledge in the art that 3.5 mm is a good size to retain sufficient capillary action to keep ink from flowing out of the pen filler from an open end opposite to the writing tip 3. While the retractable pen in the prior art may have various diameter sizes, and some may even have an interior space sufficiently large to contain a regular sized pen. Such large retractable pens, however, does not have the necessary parts to securely retain a regular sized pen and allowing proper retraction and extension of its writing tip. No matter how large the diameter of the prior art retractable pen is, such retractable pens always has the same size of filler. It is rather undesirable and unexpected to have a retractable pen that is capable of holding a filler with a diameter of more than 5 mm. Further, prior art retractable pens teach that large fillers are undesirable because it does not have sufficient capillary force to hold the ink. As such, no prior art retractable pen is capable of holding such large filler. Moreover, one skilled in the art also does not see the need to have a retractable pen that can hold another regular sized pen. One of ordinary skill in the art considers such idea to be redundant, costly, and undesirably increases the number of component parts in a pen.

In one embodiment, the holder 120 has a contact surface 136 on the inside wall of the holder 120 to frictionally engage with the outer tubular body of the pen 2. To facilitate frictional engagement, this contact surface can have a resilient material. For example, the resilient material may be foam, rubber, and plastic. In the alternative or in addition to the resilient material, the contact surface 136 can have a certain texture or structure to help increase friction. For example, there may be indentations, raised bumps, raised striations, or any other known ways to help the holder 120 in making a secure gripping of the writing instrument 2. Another contemplated design is for the holder 120 to have a tapered inside surface (e.g., narrowing diameter) so as to facilitate secure engagement of the writing instrument 2 to the holder 120.

In order to retract the writing instrument 2 disposed within lumen 111, the adapter 1 has a retractable mechanism to selectively move the holder 120 within a defined longitudinal distance within the adapter body 110 such that movement of the holder 120 towards the distal end of the adapter 1 causes the writing tip 3 to extend through the opening 152 and be exposed from the adapter body 110 for writing. Likewise, movement of the holder 120 towards the proximal end causes the writing tip 3 to retract through the opening 152 and be hidden and protected within the adapter body 110. And in the case as shown in FIG. 3, the writing tip 3 would retract and be hidden within cone tip 150, which is part of the adapter body 110 assembly.

A wide variety of retractable mechanism may be used. One preferred embodiment utilizes a retractable mechanism using principles of known bounce device as disclosed in U.S. Pat. No. 6,280,110, which is hereby incorporated by reference in its entirety.

In FIG. 3, the retractable mechanism has a compression coil spring 140 disposed between an outside wall of the holder and the inner wall of the adapter body. FIG. 3 shows spring 140 when the adapter 1 is disassembled. In FIG. 3, the spring 140 has a diameter large enough to wrap around the tubular body of the holder 120. Once assembled, the spring 140 goes over the holder 120, and its proximal end abuts against a cylinder part 128. Cylinder part 128 is disposed around the outside wall of the holder 120 and between the stopper 124 and the spring 140. When the spring 140 does not abut against the cylinder part 128, the cylinder part 128 has a free range of rotary motion around the holder and a free range of longitudinal motion along a length of the holder. Stopper 124, on the other hand, is fixed to and disposed on the outside wall of the holder 120. Stopper 124 has a first set of matching teeth 125 on its distal end, and is adjacent to tubular body 122.

The purpose of spring 140 is to bias the writing instrument 2 towards a proximal end. The spring does this by pressing against the cylinder part 128, which in turn presses against the stopper 124. Because stopper 124 is fixed (or an integral part of) on the holder 120, and holder 120 securely holds the writing instrument 2, the spring 140 in effect biases the writing instrument 2 towards the proximal end.

Another purpose of the spring 140 is to bias the bottom 130 of the cylinder part 128 to engage with stopper 124 and groove-and-rib assembly 114. Cylinder part 128 has lock keys 129 to make engaging contact with the groove-and-rib assembly 114. One of ordinary skill in the art will readily recognize the purpose of this engagement as disclosed in U.S. Pat. No. 6,280,110 for a bounce device.

Figure 4:
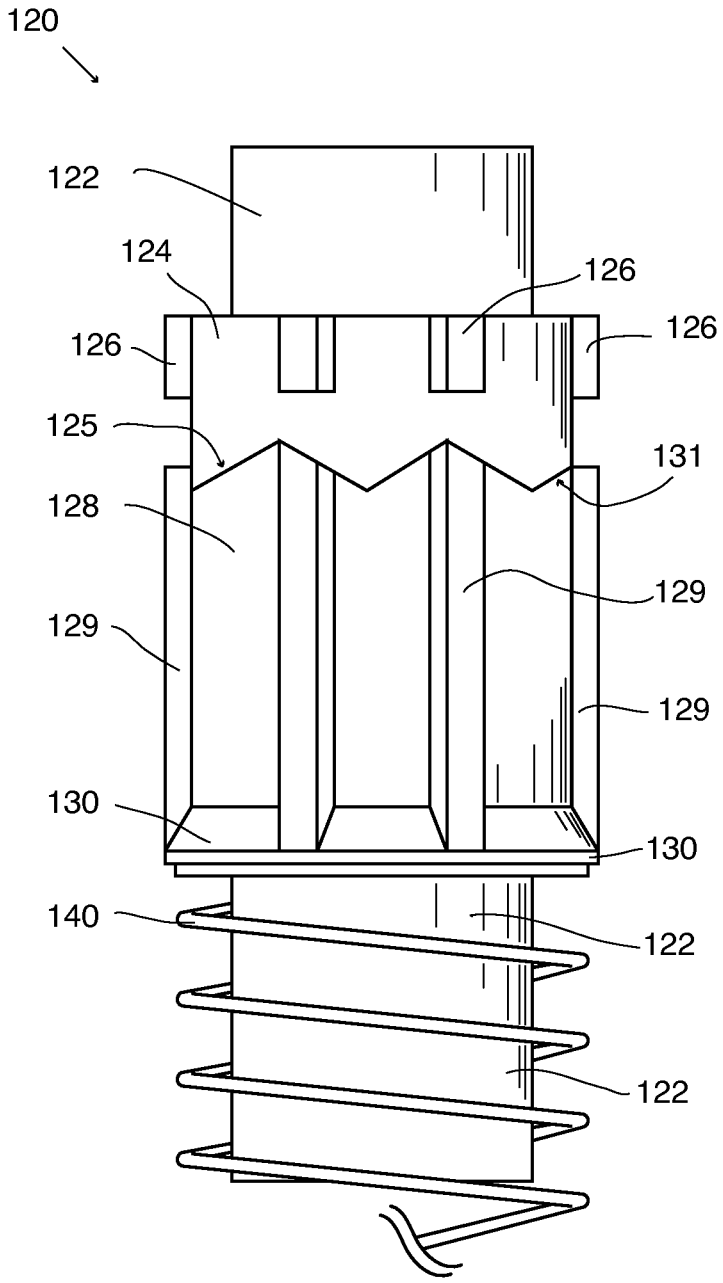
FIG. 4 is a side view of the holder of a first embodiment of the adapter.

In FIGS. 3 and 4, the cylinder part 128 has a second set of matching teeth 131 to make mating contact with the first set of matching teeth from the stopper 124. The purposes of these parts are commonly known in the art for bounce device as disclosed in U.S. Pat. No. 6,280,110.

Referring now to FIG. 3, the retractable adaptor 1 for holding an off-the-shelf writing instrument has a groove-and-rib assembly 114 disposed on an inside wall of the adapter body, wherein the groove-and-rib assembly has a rib 115, a key groove 116, and a slant post 117. The purposes and construction of these parts are commonly known in the art for bounce device as disclosed in U.S. Pat. No. 6,280,110.

Referring now to FIG. 4, the stopper 124 has a set of projections 126 disposed on the stopper 124 to make engaging contact with the groove-and-rib assembly 114. Again, the purposes and operation of these parts are commonly known in the art for bounce device as disclosed in U.S. Pat. No. 6,280,110.

In a preferred embodiment, the adapter body 110 is equal to or shorter than 13.0 cm, so that when the lumen encloses the writing instrument 2, a proximal end of the writing instrument opposite the writing tip 3 is exposed and not enclosed within the lumen 111. This way, pressing of the proximal end of the writing instrument 2, when it is held by the holder 120, towards a distal direction, causes the writing tip 3 of the pen to either extend or retract from the opening 152 of the adapter body 110. Referring back to FIG. 1, the adapter 1 can have a total length that is shorter than the writing instrument 2, so that the proximal end of the writing instrument 2 acts as the push button. Also, a user may place the original cap of the writing instrument 2 on its proximal end so that the user may continue to use the cap to clip the adapter in his shirt pocket.

Figure 5:
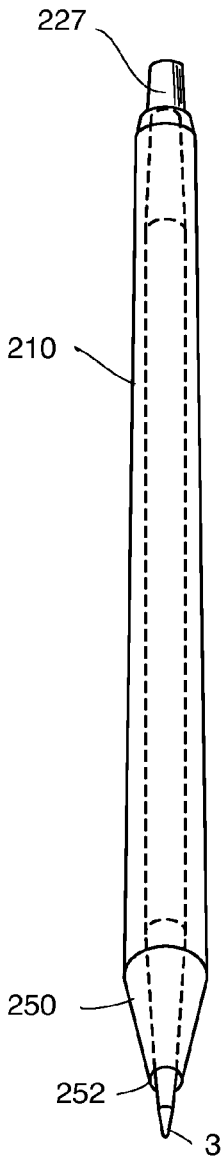
FIG. 5 is a side view of a second embodiment of the adapter with a pen entirely enclosed within the adapter in dotted lines, wherein only the writing tip is exposed.
Figure 6:
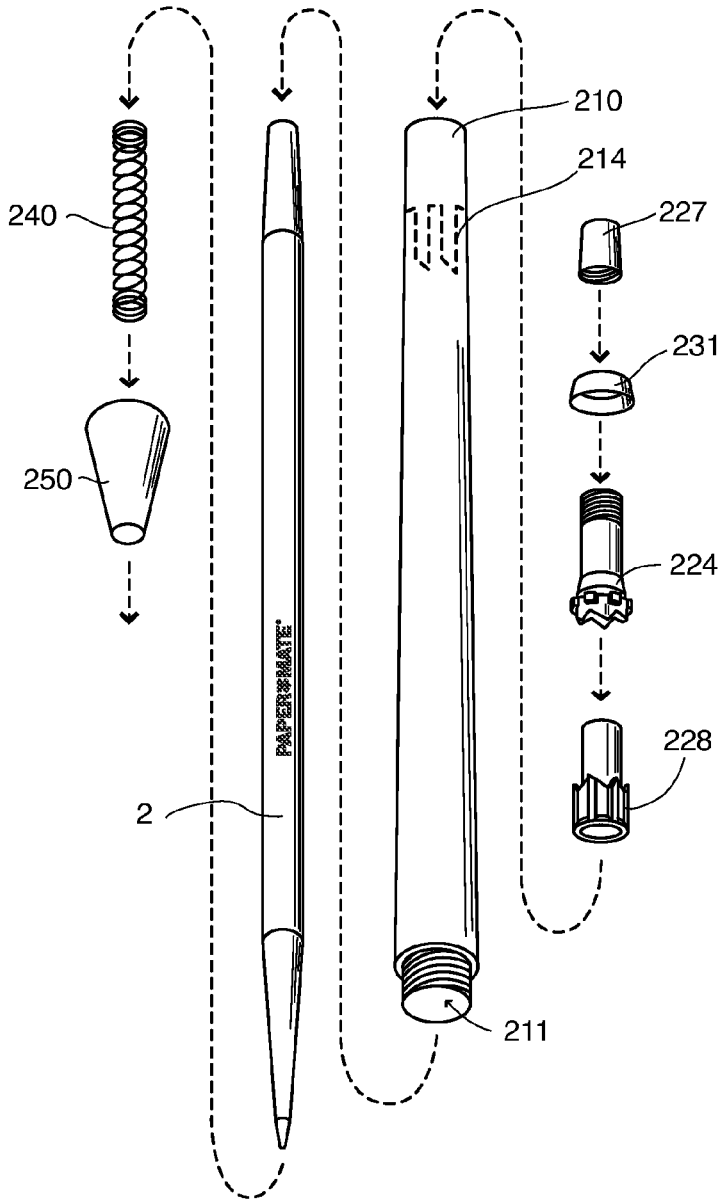
FIG. 6 is an exploded view of second embodiment of the adapter with a pen.

Referring now to FIGS. 5 and 6, another embodiment of the adapter 1 is shown. This embodiment is similar to the concept shown in FIGS. 1-4, except that the adapter body 210 is sufficiently long so that the entire writing instrument 2 is enclosed within the adapter 1. Because the entire writing instrument is enclosed, the only part that is exposed is the writing tip 3. This embodiment uses bounce device as commonly known, and a push cap 227 is provided and coupled to a top end of stopper 224. Also, as one skilled in the art will immediately recognize, cylinder part 228 has a top end that inserts into the hollow interior of the stopper 224 through a bottom opening of the stopper 224. FIG. 6 also shows a ring cap 231 to cap off the top of the adapter 1 by screw blades. The bounce device also includes a groove-and-rib assembly 214 dispose on the inside wall of the adapter body 210.

In FIGS. 1-6, the groove-and-rib assembly 214 is located on the inside wall of the adapter body 210 to cooperate with cylinder part 228 and stopper 224 that are coupled to the writing instrument 2. These parts can be arranged in reverse ways to achieve the same result. For example, the groove-and-rib assembly 214 can couple to the writing instrument 2, while the cylinder part 228 and stopper 224 are disposed on the inner wall of the adapter body 210.

Figure 7:
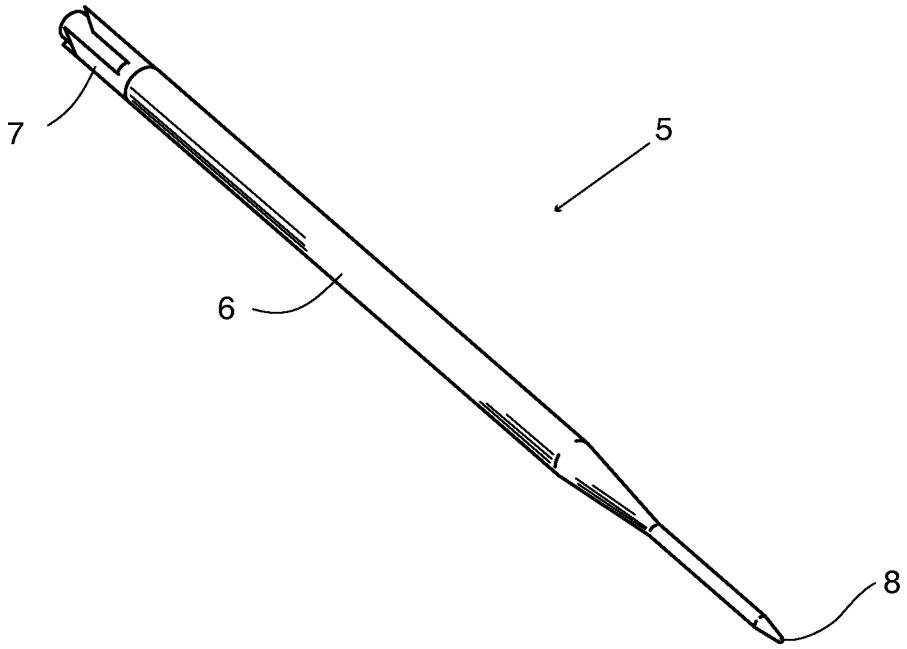
PRIOR ART FIG. 7
FIG. 7 is a perspective view of a prior art pen re-fill.

FIG. 7 illustrates a prior art retractable pen re-fill 5, the main body 6 is a metal tube ink reservoir that tapers and has a ballpoint tip 8. The proximal end of the re-fill is a blue plastic groove-and-rib end 7. This plastic groove-and-rib end 7 is not readily detachable from the main body 6, and is sized and dimensioned to be an integral part of the re-fill. It is undesirable for this plastic groove-and-rib end 7 to be detachable from the main body 6.

Figure 8:
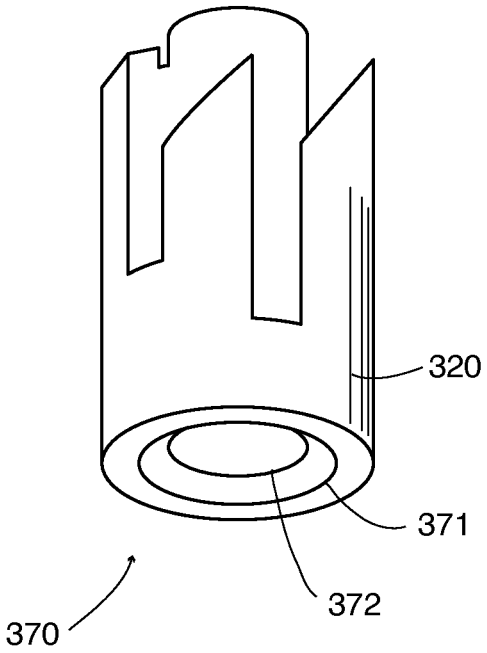
FIG. 8 is a perspective view of another embodiment of a holder for a third embodiment of the adapter.

FIG. 8 shows holder 320 to be used in yet another preferred embodiment of the inventive subject matter. Holder 320 is disposed inside the adapter body and has a bottom end 370 to make abutting contact with the proximal end of the writing instrument 2. Similar to the assembly as shown in FIG. 6, a regular pen 2 is biased by spring 240 towards the proximal end, and instead of using the arrangement of cylinder part 228, stopper 224 as shown in FIG. 6, holder 320 is arranged to contact the proximal tip of the writing instrument 2 in ways similar to the prior art re-fill 5 of FIG. 7. Here, holder 320 is readily detachable so that a user may freely replace the regular pen 2 with a new regular pen 2. Bottom end 370 of holder 320 has a contact surface. This contact surface can have a resilient material. For example, the resilient material may be foam, rubber, and plastic. In the alternative or in addition to the resilient material, the contact surface 136 can have a certain texture or structure to help securely steadily centering the writing instrument 2. For example, there may be indentations, raised bumps, raised striations, or any other known ways. As shown in FIG. 8, bottom end 370 has two circular indentations resembling a ladder structure. The first circular indentation 371 has a diameter substantially the same as the proximal end diameter of a BIC® pen. The smaller and deeper circular indentation 372 has a diameter substantially the same as the proximal end diameter of a Paper Mate® pen. Such design provides a universal holder 320 that can readily fit over two different types of pens that are commonly used in work places.

Referring now to FIGS. 9-14; another embodiment of the adapter 1 is shown. This embodiment is similar to the concept shown in FIGS. 1-8, except the retractable mechanism is different. Here, adapter body 410 includes a detachable cone tip 450, and cone tip 450 has a narrowed opening 452 for writing tip 3 of a writing instrument 2 to pass through. FIG. 5 shows the adapter 1 with a Paper Mate® brand pen assembled within. Dotted lines show a holder 420 inside the adapter body 410, securely holding the pen 2.

Figure 10:
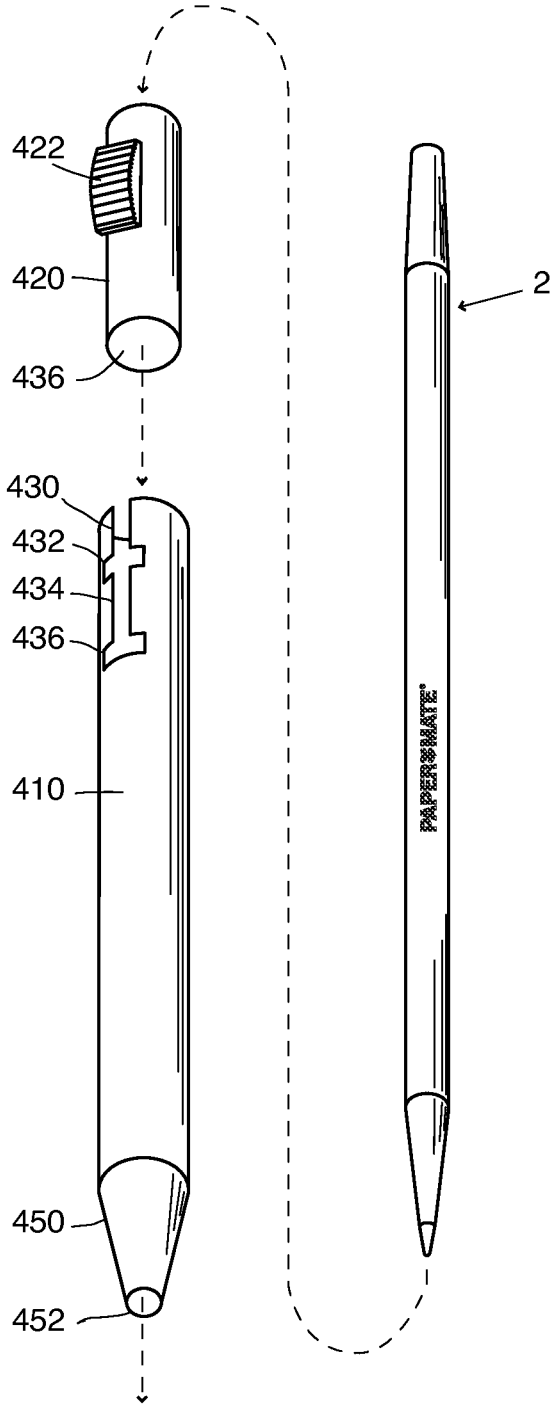
FIG. 10 is an exploded view of a fourth embodiment of the adapter with a pen.
Figure 11:
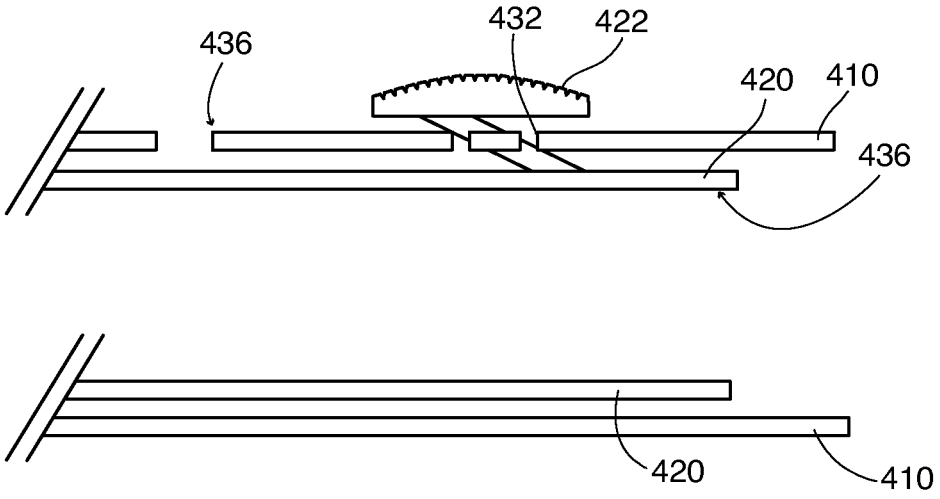
FIG. 11 is a longitudinal cross-sectional view of the adapter body, holder, and slider of the fourth embodiment.
Figure 12:
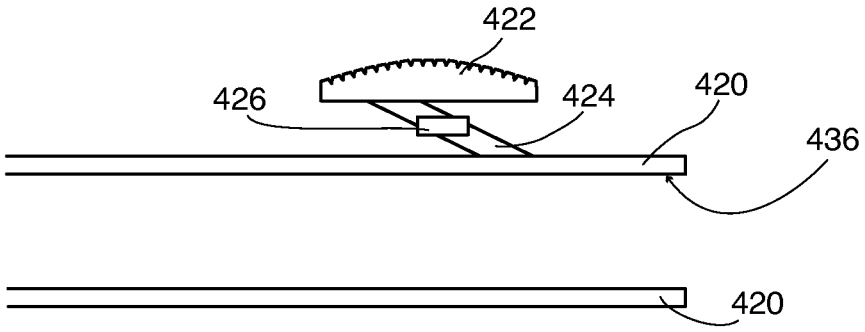
FIG. 12 is a longitudinal cross-sectional view of the holder, and slider of the fourth embodiment.
Figure 13:
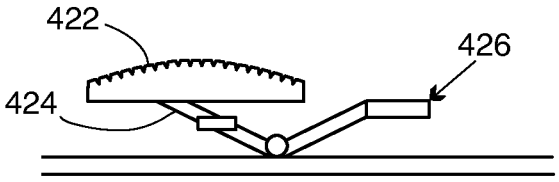
FIG. 13 is a longitudinal cross-sectional view of the holder, and another embodiment of the slider.
Figure 14:
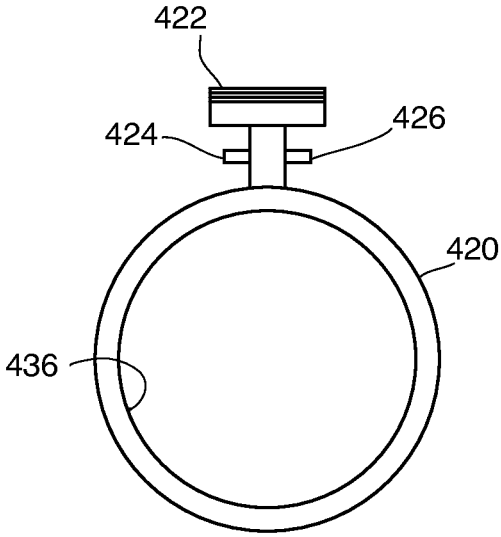
FIG. 14 is a transverse cross-sectional view of the holder, and the slider.

FIG. 10 shows that the pen 2 is first inserted through the lumen 436 of the holder 420, and is securely coupled to the holder 420 by methods discussed in this application. The holder is then inserted into the adapter body 410. The holder has a slider 422 to cooperate with a track as defined by 430, 432, 434, and 436. A user may slide the holder 420 by using the slider 422, thereby extending and retracting the writing tip 3 of the pen 2 through the distal opening 452.

FIGS. 11-14 illustrate how the slider 422 enables sliding and locking of positions with respect to the track. Here, slider 422 is coupled to a stem 424, and the stem is coupled to a block 424. The stem 424 is relatively flexible and preferably made of plastic such that when a user presses the slider 422 in a downward direction as shown in the figures, the stem 424 will bend and thus move block 424 out of plane, and out of contact with the tract so that the slider 422 may now slide to the next position. Similar structures are known in the art for retractable erasers. Other known slider assembly can also be used, such as those taught in U.S. Pat. No. 6,773,185 issued to Hsieh; British Patent No. 755,879; U.S. Pat. No. 4,167,350 issued to Harris; U.S. Design Pat. No. 386,526 issued to Ito; U.S. Design Pat. No. 303,992 issued to Grotsch; U.S. Pat. No. 5,048,989 issued to Stageman; all of which are incorporated by reference in their entireties.

Figure 9:
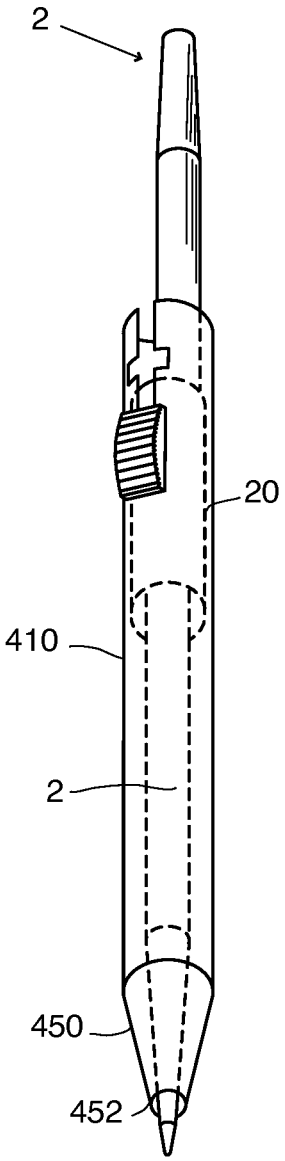
FIG. 9 is a perspective view of a fourth embodiment of the adapter with a pen partially enclosed within.

While the embodiment in FIGS. 9 and 10 shows an adapter 1 that is shorter than the writing instrument 2, another embodiment is contemplated to have an adapter body 410 sufficiently long to completely enclose the entire writing instrument 2. Such embodiment provides a top adapter body similar to the top adapter body 518 shown in FIG. 16.

Figure 15:
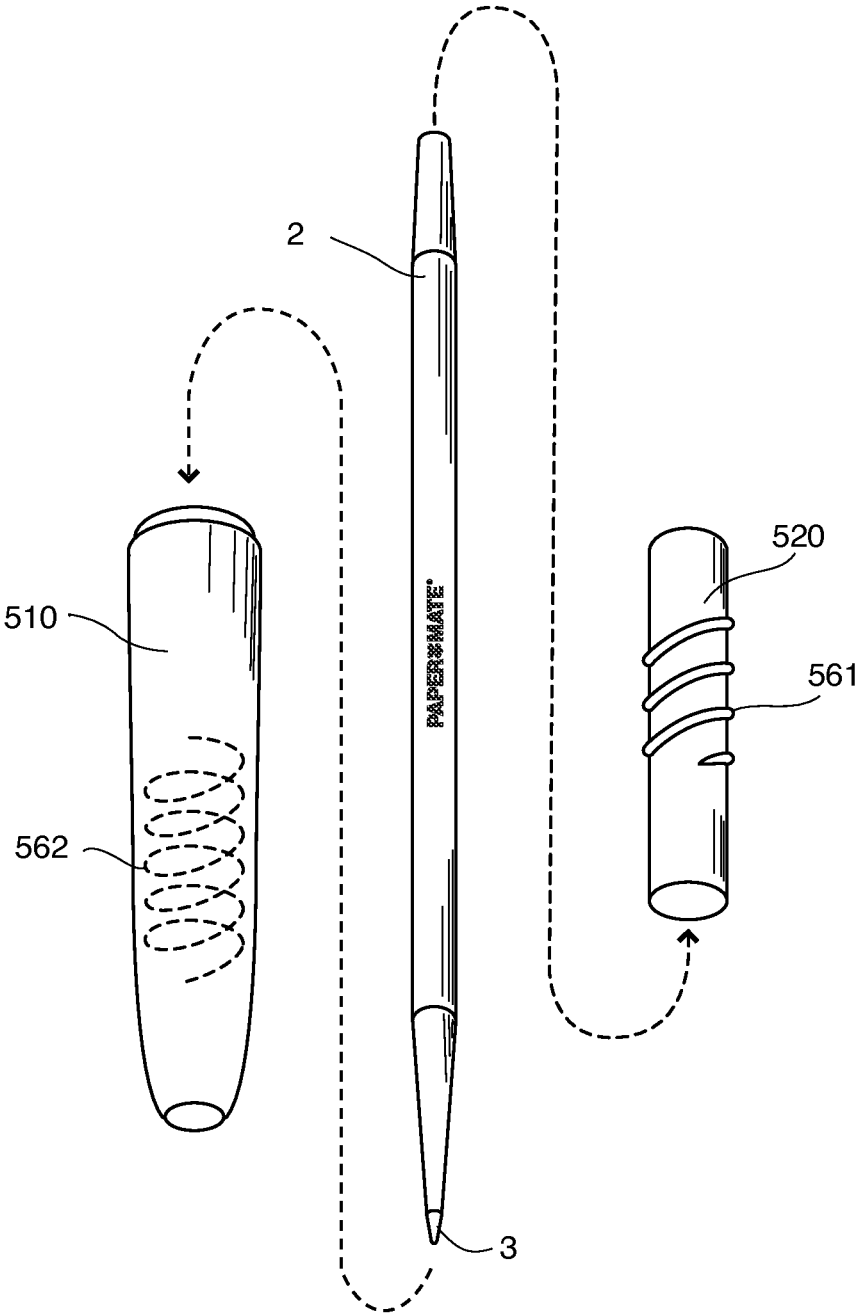
FIG. 15 is an exploded view of a fifth embodiment of the adapter with a pen.
Figure 16:
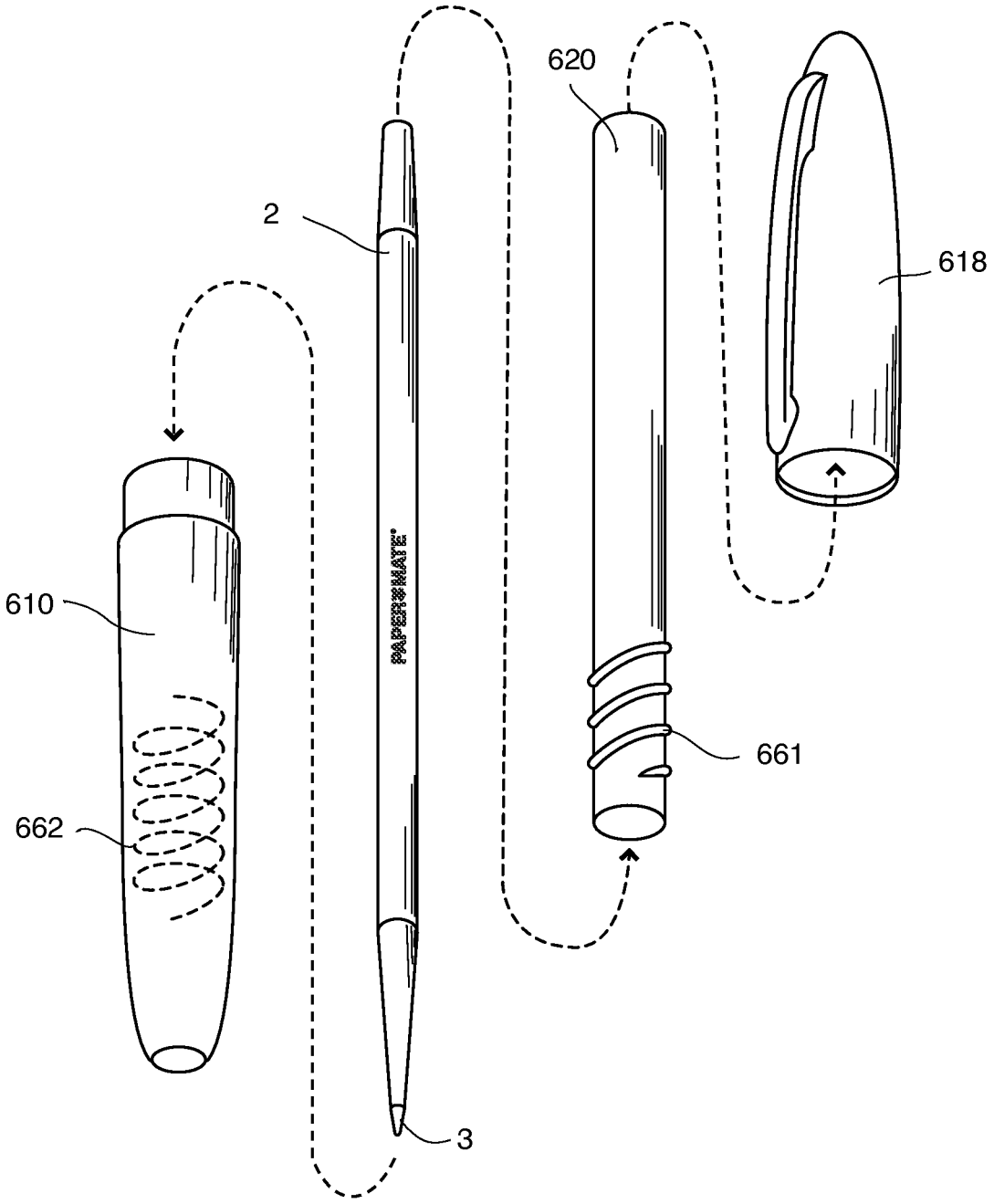
FIG. 16 is an exploded view of a sixth embodiment of the adapter with a pen.

Referring now to FIGS. 15 and 16; twister-type embodiments are shown with a regular off-the-shelf writing instrument installed. In FIG. 15, holder 520 is a hollow cylinder structure with two open ends. Holder 520 securely holds a middle portion of pen 2. Similar to other holders previously discussed in this application, holder 520 has an interior contact surface of desired structure and/or material that sufficiently secure the pen 2 so the pen does not freely slide out of the holder 520.

Once secured by holder 520, the pen 2 and the holder 520 is inserts into the hollow lumen of adapter body 510. Holder 561 has screw blade 561 disposed on its outside wall, to cooperate with the screw blade 562 disposed on the inside wall of the adapter body 510. In operation, the adapter body 510 is similarly sized as discussed in embodiments of FIG. 3, thus the proximal end of the pen is disposed from the adapter body 510. To extend or retract the writing tip 3, a user simply twists the proximal end of the pen 2 relative to the adapter body 510.

FIG. 16 illustrates an improvement of the embodiment as shown in FIG. 15, except that the adapter is designed to enclose the entire writing instrument 2. Here, an adapter top body 618 is used to cap over the proximal end of the pen 2. Also the holder 620 is sufficiently long to extend to outside of the adapter body 610. The exposed portion of the 620 is to contact an interior surface of the adapter top body 618. Top body 618 securely engages contact with holder 661 so that when a user twists the top body 518, it in turn twists the holder 661 to move the holder 661 in a longitudinal direction. Thus, once installed, the top body 618 freely rotates in relation to the adapter body 610.

All of the embodiments disclosed herein may contain suitable natural or synthetic material. It is further contemplated that suitable ergonomic design and/or material such as rubber and/or gel-grip may be used as the exterior of the adapter body to provide comfort and to prevent slippage from user's fingers.

Thus, specific embodiments and applications of Adapter for Writing Instrument have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from the group consisting of A, B, C . . . and N, the text should be interpreted as requiring only one element from the group, not A plus N, or B plus N, etc.

What is claimed is:

1. A retractable adaptor for holding an off-the-shelf writing instrument having a writing tip, wherein the adaptor comprises:

an adapter body having a distal end and a proximal end;

a lumen within the adapter body to at least partially enclose the writing instrument;

an opening at the distal end of the adapter body allowing a writing tip of the writing instrument to pass through;

a holder disposed within the lumen of the adapter body to contact the writing instrument;

a contact surface disposed on an inner side of the holder to make engaging contact with the writing instrument;

a retractable mechanism to selectively move the holder within a defined longitudinal distance within the adapter body such that movement of the holder towards the distal end causes the writing tip to extend through the opening and be exposed from the adapter body for writing, and movement of the holder towards the proximal end causes the writing tip to retract through the opening and be hidden and protected within the adapter body; and wherein the off-the-shelf writing instrument is a pen having an ink filling holding ink, an outer tubular body having an outer diameter of at least 6 mm and encloses the ink filling.

2. The retractable adaptor for holding an off-the-shelf writing instrument as recited in claim 1 further comprising a resilient material disposed on the contact surface of the holder to frictionally engage with the outer tubular body of the pen, wherein the resilient material is at least one selected from the group consisting of foam, rubber, and plastic.

3. The retractable adaptor for holding an off-the-shelf writing instrument as recited in claim 1, wherein the retractable mechanism further comprises:

a compression coil spring disposed between an outside wall of the holder and the inner wall of the adapter body;

a stopper fixed and disposed on the outside wall of the holder and having a first set of matching teeth;

a cylinder part disposed around the outside wall of the holder and between the first and the second stoppers, the cylinder part having a range of rotary motion around the holder and a range of longitudinal motion along a length of the holder; and wherein the cylinder part has a second set of matching teeth to make mating contact with the first set of matching teeth.

4. The retractable adaptor for holding an off-the-shelf writing instrument as recited in claim 3, wherein the retractable mechanism further comprises:

a groove-and-rib assembly disposed on an inside wall of the adapter body, wherein the groove-and-rib assembly has a rib, a key groove, and a slant post;

a set of projections disposed on the stopper to make engaging contact with the groove- and-rib assembly; and a set of lock keys disposed on the cylinder part to make engaging contact with the groove-and-rib assembly.

5. The retractable adaptor for holding an off-the-shelf writing instrument as recited in claim 4, wherein the adapter body further comprises a detachable cone tip detachably coupled to a main body of the adaptor body, and the opening on the distal end of the adapter body is disposed on a narrow end of the cone tip, and wherein an end of the first compression coil spring make abutting contact with an inside of the cone tip.

6. The retractable adaptor for holding an off-the-shelf writing instrument as recited in claim 5, wherein the adapter body is equal to or shorter than 13.0 cm, so that when the lumen encloses the pen, a proximal end of the pen opposite the writing tip is exposed and not enclosed within the lumen; and pressing of the proximal end of the pen, when it is held by the holder, towards a distal direction, causes the writing tip of the pen to either extend or retract from the opening of the adapter body.

7. The retractable adaptor for holding an off-the-shelf writing instrument as recited in claim 1 further comprising:

a compression coil spring disposed in the lumen near the distal end of the adapter body, so that when a pen is at least partially enclosed in the adapter body, a proximal end of the spring secures around the pen and biases the pen towards the proximal end of the adapter body;

wherein the holder makes abutting contact with a proximal end of the pen when the pen is at least partially enclosed within the lumen of the adapter body.

8. The retractable adaptor for holding an off-the-shelf writing instrument as recited in claim 7, wherein the retractable mechanism further comprising:

a push cap partially extending through the proximal end of the adapter body;

a stopper coupled to the push cap, the stopper has projections and a first set of matching teeth;

a cylinder part having lock keys and a second set of matching teeth; and wherein the upper matching teeth makes mating contact with the lower matching teeth.

9. The retractable adaptor for holding an off-the-shelf writing instrument as recited in claim 8 further comprising a centering device disposed in the lumen making contact with the pen to ensure the pen is centered within the lumen.

10. The retractable adaptor for holding an off-the-shelf writing instrument as recited in claim 1, wherein the adapter body has a first tubular part and a second tubular part, and wherein the retractable mechanism further comprising:

a first set of matching screw blade disposed on an outside of the holder;

a second set of matching screw blade disposed on an inside of the first tubular part of the adapter body; and wherein an user-actuated rotation of the first tubular part relative to the second tubular part causes the second set of matching screw blade to act on the first set of matching screw blade, and cause the holder to move in a longitudinal direction within the lumen relative to the adapter body.

11. The retractable adaptor for holding an off-the-shelf writing instrument as recited in claim 1, wherein the adapter body has a length of equal to or shorter then 13.0 cm, such that when a pen is held in the adapter body, a proximal end of the pen is exposed outside of the lumen, and wherein the retractable mechanism further comprising:

a spiral track disposed on an inside of the first tubular part of the adapter body;

wherein the holder makes secure contact with the pen;

at least one protuberance disposed on an outside of the holder to cooperate with the spiral track such that an user-actuated rotation of the exposed proximal end of the pen relative to the adapter body causes the holder to move in a longitudinal direction within the lumen relative to the adapter body.

12. A retractable adaptor for holding an off-the-shelf writing instrument having a writing tip, wherein the adaptor comprises:

an adapter body having a distal end, a proximal end, and a lumen;

an opening at the distal end of the adapter body allowing a writing tip of the writing instrument to pass through;

a push cap;

an opening at the proximal end of the adapter body allowing the push cap to partially pass through and be exposed outside of the lumen;

a compression coil spring disposed in the lumen biasing the writing instrument towards the proximal end, when the writing instrument is assembled in the lumen;

a holder in the lumen that makes abutting contact with the writing instrument when the pen is enclosed within the lumen of the adapter body;

a stopper coupled to the push cap, the stopper has projections and upper matching teeth disposed at a region towards a distal end of the stopper;

a cylinder part at least partially disposed within a lumen of the stopper, the cylinder part having lock keys and lower matching teeth disposed at a region towards a distal end of the cylinder part;

wherein the holder is coupled to the distal end of the cylinder part;

wherein the upper matching teeth makes mating contact with the lower matching teeth; and wherein the off-the-shelf writing instrument has an outer body having an outer diameter of at least 6 mm.

13. The retractable adaptor for holding an off-the-shelf writing instrument as recited in claim 12, wherein the writing instrument is one selected from a group consisting of a regular pen and a regular pencil.

* * * * *